US006534552B2

(12) United States Patent
Benham et al.

(10) Patent No.: US 6,534,552 B2
(45) Date of Patent: Mar. 18, 2003

(54) PRODUCING LIQUID HYDROCARBONS FROM NATURAL GAS

(75) Inventors: Charles B. Benham, Littleton, CO (US); Mark S. Bohn, Golden, CO (US); Dennis L. Yakobson, Arvada, CO (US)

(73) Assignee: Rentech, Inc., Denver, CO (US)

( * ) Notice: Subject to any disclaimer, the term of this patent is extended or adjusted under 35 U.S.C. 154(b) by 0 days.

(21) Appl. No.: 09/870,466

(22) Filed: Jun. 1, 2001

(65) Prior Publication Data

US 2002/0032244 A1 Mar. 14, 2002

Related U.S. Application Data

(62) Division of application No. 09/281,794, filed on Mar. 31, 1999, now abandoned.
(60) Provisional application No. 60/080,177, filed on Mar. 31, 1998.

(51) Int. Cl.[7] ..... C07C 27/00
(52) U.S. Cl. ..... 518/715; 518/703; 518/704; 518/705; 518/700
(58) Field of Search ..... 518/700, 703, 518/704, 705, 715

(56) References Cited

U.S. PATENT DOCUMENTS

| | | | | |
|---|---|---|---|---|
| 3,965,045 A | | 6/1976 | Leach | |
| 4,044,063 A | | 8/1977 | Ireland et al. | |
| 4,049,741 A | | 9/1977 | Kuo et al. | |
| 4,076,761 A | | 2/1978 | Chang et al. | |
| 4,092,825 A | | 6/1978 | Egan | |
| 4,833,170 A | | 5/1989 | Agee | |
| 4,973,453 A | | 11/1990 | Agee | |
| 5,023,276 A | | 6/1991 | Yarrington et al. | |
| 5,543,437 A | * | 8/1996 | Benham et al. | 518/700 |
| 5,620,670 A | | 4/1997 | Benham et al. | |
| 5,621,155 A | | 4/1997 | Benham et al. | |

* cited by examiner

*Primary Examiner*—Jafar Parsa
(74) *Attorney, Agent, or Firm*—Shoemaker and Mattare

(57) ABSTRACT

Increased hydrocarbon yields from natural gas and reduced oxygen consumption improvements are obtained by recycling hydrogen to a Fischer-Tropsch reactor, which can have a catalyst exhibiting either a low water gas shift activity such as cobalt, or a high water gas shift activity such as iron. At least a portion of the remaining tail gas, either before or after the hydrogen has been removed, is recycled to the inlet of the synthesis gas production reactor.

7 Claims, 4 Drawing Sheets

PRODUCING LIQUID HYDROCARBONS FROM NATURAL GAS

This application is an division of application Ser. No. 09/281,794, filed Mar. 31, 1999 now abandoned, which claims priority from provisional application No. 60/080,177 filed Mar. 31, 1998.

BACKGROUND OF THE INVENTION

1. Field of the Invention

This invention relates to an improved process for the conversion of natural gas into valuable liquid hydrocarbon products by subjecting the natural gas to partial oxidation or autothermal reforming to produce synthesis gas and converting the synthesis gas into valuable products using a Fischer-Tropsch (FT) reactor.

2. Chemistry

The partial oxidation (POX) reaction can be expressed as:

$$CH_z+\tfrac{1}{2}O_2 \rightarrow z/2H_2+CO$$

where z is the H:C ratio of the hydrocarbon feedstock. The water gas shift (WGS) reaction also takes place:

$$H_2O + CO <==> H_2 + CO_2$$

The Fischer-Tropsch (FT) synthesis reaction is expressed by the following stoichiometric relation:

$$2n\ H_2+nCO \rightarrow C_nH_{2n}+nH_2O$$

The aliphatic hydrocarbons produced by the Fischer-Tropsch reaction have an H:C atom ratio of 2.0 or greater.

Catalysts such as iron-based also catalyze the water gas shift (WGS) reaction:

$$H_2O + CO <==> H_2 + CO_2$$

If all of the water produced in the FT reaction were reacted with CO in the WGS reaction, then the overall consumption of hydrogen would be one-half of the consumption of carbon monoxide. If none of the water were reacted in the WGS reaction (no WGS activity) then the consumption of hydrogen would be twice the consumption of carbon monoxide.

3. Description of the Previously Published Art

For a natural gas feedstock which contains no or little carbon dioxide, Benham et al. (U.S. Pat. Nos. 5,620,670 and 5,621,155) teach that carbon dioxide recycle (including carbon dioxide produced in the synthesis step) back to the synthesis gas producing step (either partial oxidation, autothermal reforming or steam reforming) decreases the excessively high $H_2$:CO ratio of the synthesis gas and increases the yield of the Fischer-Tropsch (FT) hydrocarbons and the attendant carbon conversion-efficiency. The aforementioned patents also teach that recycling both tail gas and carbon dioxide back to the synthesis gas producing step can be used to effect an increase in hydrocarbon yields.

Yarrington et al (U.S. Pat. No. 5,023,276) describe a gas to liquids system wherein synthesis gas is produced using autothermal reforming of natural gas with carbon dioxide recycled from the outlet of the autothermal reformer back to the inlet of the autothermal reformer. Means are also provided for recycling tail gas from the Fischer-Tropsch reactor back to the autothermal reformer inlet.

Agee (U.S. Pat. Nos. 4,833,170 and 4,973,453) describes a gas to liquids system which uses autothermal reforming of natural gas with air as the oxidizing gas and a cobalt-based Fischer-Tropsch reactor. Means are provided for combusting tail gas and light hydrocarbons and for recovering carbon dioxide from the flue gases. Some of the carbon dioxide is recycled back to the inlet of the autothermal reformer to increase the yield of liquid hydrocarbon product. The amount of carbon dioxide in the feed gas to the autothermal reformer in the example given is about 4.3 volume percent.

SUMMARY OF THE INVENTION

It is an object of this invention to provide a Fischer-Tropsch process with a first stage gasifier which uses natural gas as the feedstock.

It is a further object of this invention to increase the hydrocarbon yields from a POX/FT or an ATR/FT system.

It is a further object of this invention to increase the hydrocarbon yields from a POX/FT or an ATR/FT system by separating hydrogen from the tail gas and recycling the hydrogen back to the FT reactor or to the POX or ATR reactor or to both.

It is a further object of this invention to increase the $H_2$:CO ratio of the synthesis gas fed to the FT reactor by using hydrogen recycle.

It is a further object of this invention to increase the $H_2$:CO ratio in a POX/FT or an ATR/FT system so as to increase catalyst stability and life.

It is a further object of this invention to recycle hydrogen back to the POX or ATR reactor in a POX/FT or an ATR/FT system so that less steam and oxygen are required in the POX or ATR reactor.

These and further objects of the invention will become apparent as the description of the invention proceeds.

Increased hydrocarbon product yields and reduced oxygen consumption improvements are obtained in a Fischer-Tropsch (FT) gas-to-liquids conversion apparatus by the use of additional apparatus to selectively recycle hydrogen, carbon dioxide and/or tail gas from the FT reactor. The apparatus has a first unit which is a synthesis gas production reactor for producing synthesis gas from a natural gas feedstock. Examples of such reactors are a partial oxidation (POX) reactor or an autothermal reactor (ATR). The second unit is a synthesis gas conversion apparatus which is the FT reactor. The FT reactor can have a catalyst exhibiting either a low water gas shift (WGS) activity such as cobalt or a high water gas shift (WGS) activity such as iron. The improved results are obtained by using a hydrogen gas separating and recycling system for separating the hydrogen from the tail gas exiting the FT reactor and recycling at least a portion of the separated hydrogen back to the inlet of the FT reactor or the synthesis gas production reactor. In addition, depending on the nature of the oxidizing gas used in the synthesis gas production reactor, the nature of the catalyst in the FT reactor, and whether a POX or ATR unit is employed, (1) a tail gas recycling system may be employed for recycling at least a portion of the remaining tail gas, either before or after the hydrogen has been removed, to the inlet of the synthesis gas production reactor or (2) a carbon dioxide gas separating and recycling system may be employed for separating the carbon dioxide from the tail gas exiting from the FT reactor and recycling at least a portion of the carbon dioxide to the inlet of the synthesis gas production reactor.

In the case where oxygen is used as the oxidizing gas and the FT reactor has a catalyst with a high water gas shift (WGS) activity such as an iron catalyst, then improved results can be obtained by recycling the separated hydrogen to either the FT unit or the POX or ATR reactor and recycling at least a portion of the tail gas, either before or after the hydrogen is removed, back to the POX or ATR reactor. In the case where the hydrogen is removed from the tail gas and recycled back to the POX or ATR unit and the remaining tail gas without the hydrogen is recycled back to the POX or ATR unit, it is preferred to recycle 85% to 100% of the hydrogen and 70% to 80% of the tail gas to the POX or 80% to 90% of the tail gas to the ATR. When the hydrogen is recycled to the FT unit and the remaining tail gas without the hydrogen in recycled back to the POX or ATR unit, it is preferred to recycle 85% to 100% of the hydrogen and 70% to 80% of the tail gas to the POX or 80% to 90% of the tail gas to the ATR. When a portion of the tail gas is recycled directly back to the POX or ATR unit and the hydrogen is removed from the remaining tail gas for recycle to the POX or ATR unit, then it is preferred to recycle 85% to 100% of the hydrogen to the POX or ATR and 70% to 80% of the tail gas to the POX or 80% to 90% of the tail gas to the ATR. Finally, when a portion of the tail gas is recycled directly back to the POX or ATR unit and the hydrogen is removed from the remaining tail gas for recycle to the FT unit, then it is preferred to recycle 85% to 100% of the hydrogen to the POX or ATR and 70% to 80% of the tail gas to the POX or 80% to 90% of the tail gas to the ATR.

In the case where oxygen is used as the oxidizing gas and the FT reactor has a catalyst with low water gas shift (WGS) activity such as a cobalt catalyst, then improved results can be obtained by recycling the separated hydrogen to either the FT unit or the POX or ATR reactor and recycling at least a portion of the tail gas, either before or after the hydrogen is removed, back to the POX or ATR reactor. In the case where the hydrogen is removed from the tail gas and recycled back to the POX or ATR unit and the remaining tail gas without the hydrogen is recycled back to the POX or ATR unit, it is preferred to recycle 85% to 100% of the hydrogen and 35% to 55% of the tail gas to the POX or 60% to 80% of the tail gas to the ATR. When the hydrogen is recycled to the FT unit and the remaining tail gas without the hydrogen in recycled back to the POX or ATR unit, it is preferred to recycle 85% to 100% of the hydrogen and 35% to 55% of the tail gas to the POX or 60% to 80% of the tail gas to the ATR. When a portion of the tail gas is recycled directly back to the POX or ATR unit and the hydrogen is removed from the remaining tail gas for recycle to the POX or ATR unit, then it is preferred to recycle 85% to 100% of the hydrogen to the POX or ATR and 35% to 55% of the tail gas to the POX or 60% to 80% of the tail gas to the ATR. Finally, when a portion of the tail gas is recycled directly back to the POX or ATR unit and the hydrogen is removed from the remaining tail gas for recycle to the FT unit, then it is preferred to recycle 85% to 100% of the hydrogen to the POX or ATR and 35% to 55% of the tail gas to the POX or 60% to 80% of the tail gas to the ATR.

In the case where air is used as the oxidizing gas in a POX reactor, and the FT reactor has a catalyst with low WGS activity, then improved results can be obtained by recycling the separated hydrogen to either the FT unit or the POX reactor. It is preferred to recycle back 80 to 100% of the hydrogen from the FT reactor. The carbon dioxide can optionally be recycled to the POX reactor in an amount of 80% to 100%. In the case where air is used as the oxidizing gas in an ATR reactor, and the FT reactor has a catalyst with low WGS activity, then improved results can be obtained by recycling the separated hydrogen to either the FT unit or the ATR reactor and recycling at least a portion of the carbon dioxide back to the ATR reactor. It is preferred to recycle back 85 to 100% of the hydrogen from the FT reactor and 80–100% of the carbon dioxide back to the ATR.

In the case where air is used as the oxidizing gas in an POX reactor, and the FT reactor has a catalyst with a high WGS activity, then improved results can be obtained by recycling the separated hydrogen to either the FT unit or the POX reactor and recycling at least a portion of the carbon dioxide back to the POX reactor. It is preferred to recycle back 85% to 100% of the hydrogen from the FT reactor and 55–75% of the carbon dioxide back to the POX. In the case where air is used as the oxidizing gas in an ATR reactor, and the FT reactor has a catalyst with high WGS activity, then improved results can be obtained by recycling the separated hydrogen to either the FT unit or the ATR reactor and recycling at least a portion of the carbon dioxide back to the ATR reactor. It is preferred to recycle back 85 to 100% of the hydrogen from the FT reactor and 80–95% of the carbon dioxide back to the ATR.

DESCRIPTION OF THE PREFERRED EMBODIMENTS

Figure 1:
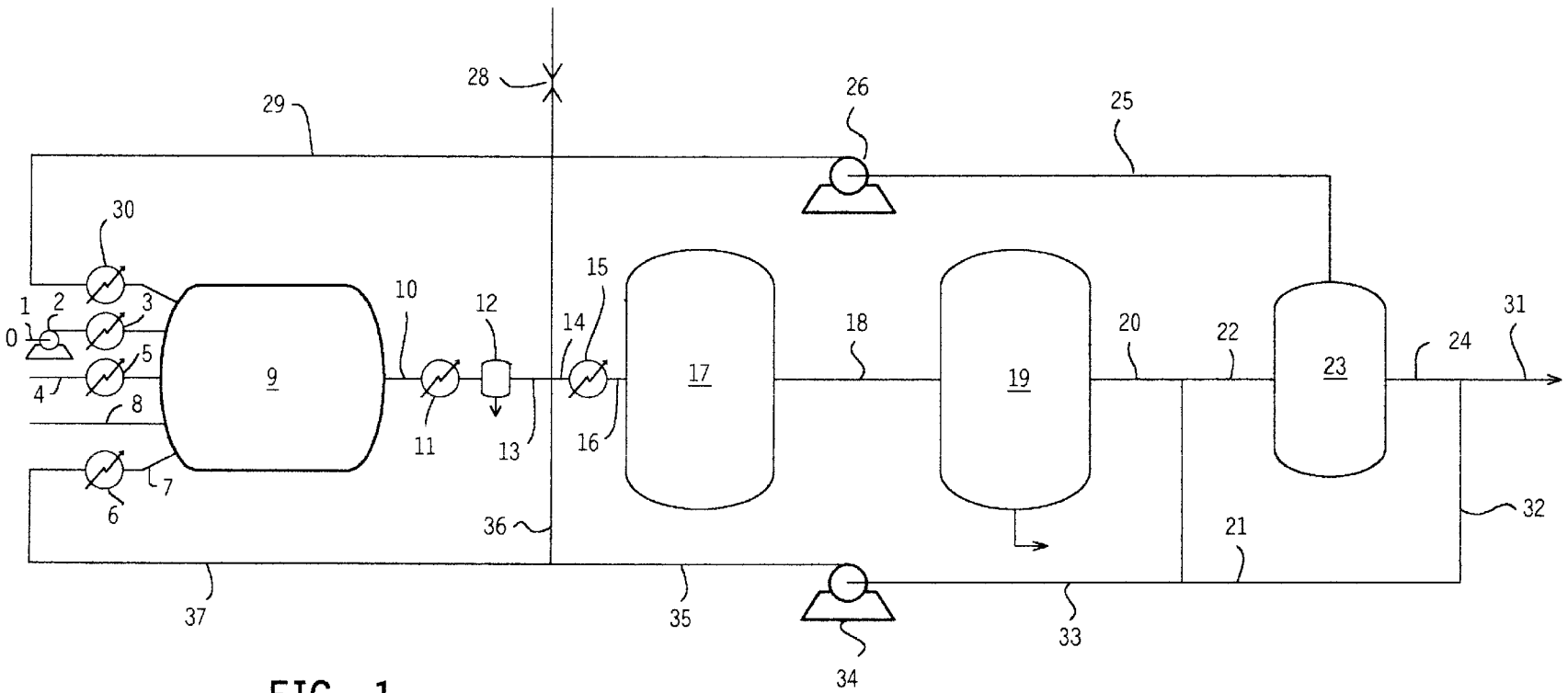
FIG. 1 is a diagram of a system using oxygen as the oxidizing gas in the POX (or ATR) reactor.

It has been discovered that by using hydrogen recycle from the tail gas exiting from a Fischer-Tropsch reactor back to the inlet of the Fischer-Tropsch reactor or to the inlet of a partial oxidation reactor or an autothermal reactor either alone or in conjunction with tail gas or carbon dioxide recycle back to a partial oxidation reactor or an autothermal reactor in a gas to liquids system an improvement in liquid hydrocarbon yield and oxygen consumption can be achieved.

The optimum amounts of hydrogen, carbon dioxide and tail gas recycle depend upon the composition of the natural gas and in particular the amount of carbon dioxide contained in the natural gas. Another important consideration is whether or not the Fischer-Tropsch catalyst exhibits water gas shift activity. The hydrogen can be recycled to the synthesis gas producing means (POX or ATR) or to the synthesis gas conversion means (FT reactor), although in general, slightly higher yields are obtained by recycling hydrogen back to the FT reactor. In a system using a FT catalyst having little or no water gas shift activity, steam addition to the POX (or ATR) is required in most cases to increase the $H_2$:CO ratio to about 2:1 if hydrogen recycle is not employed. However, by using $H_2$ recycle according to the present invention there will be a decrease in the amount of steam required in the POX reactor (or ATR) to achieve the minimum required $H_2$:CO ratio of synthesis gas fed to the FT reactor (generally about 2:1). Less steam fed to the POX reactor (or ATR) means that less natural gas combustion and less oxygen are required to heat the reactor contents to the required temperature and this results in a reduction in the energy requirements of the system. In a system using a FT catalyst having high water gas shift activity, $H_2$ recycle increases the $H_2$:CO ratio of synthesis gas which is more advantageous for catalyst stability and life than a lower ratio. Such a catalyst system does not require steam addition to the POX (or ATR) to increase the $H_2$:CO ratio of the synthesis gas fed to the FT reactor.

The improved gas to liquids process described herein incorporates a means for separating hydrogen from the tail gas either before or after the tail gas or carbon dioxide is removed for recycling.

Hydrogen recycle is effective for systems that use either oxygen or air for the synthesis gas producing step. In the case of systems which use air, tail gas recycle cannot be used due to the large amount of nitrogen present; however carbon dioxide recycle can be employed along with hydrogen recycle to maximize yields of liquid hydrocarbons produced in the FT reactor. Carbon dioxide recycle along with hydrogen recycle is effective even though the FT catalyst may not exhibit water gas shift activity which is necessary for carbon dioxide production in the FT reactor. The carbon dioxide recycled in this circumstance originates in the POX reactor or ATR and passes through the FT reactor as an inert gas.

A diagram of a gas to liquids system which uses oxygen as the oxidizing gas in a POX (or ATR) reactor is shown in FIG. 1. Referring to FIG. 1, a stream of oxygen 0 is compressed in oxygen compressor 1 and preheated in heat exchanger 3 and fed to POX (or ATR) reactor 9. Natural gas 4 is preheated in preheater 5 and fed to the POX (or ATR) reactor 9 along with preheated steam 8, recycled hydrogen 29 via preheater 30 and recycled tail gas 37 via preheater 6. The gases 10 exiting the POX (or ATR) reactor 9 are cooled in heat exchanger 11 to remove water in vessel 12. The dried gases 13 are comprised of hydrogen, carbon monoxide, carbon dioxide and small amounts of methane and nitrogen. This mixture of gases 13 is mixed with recycled hydrogen 27 and recycled tail gas 36 and then preheated in heat exchanger 15. This preheated mixture 16 is fed to a FT reactor 17 wherein liquid hydrocarbon products are produced and contained in stream 18. The products are separated in product separation unit 19 from the non-condensible tail gas 20 using well-established means such as partial condensation and distillation. A portion of the tail gas 21 is recycled back to the POX (or ATR) reactor 9 via line 37 or back to the FT reactor 17 via line 37 or back to both of the reactors after being compressed by tail gas compressor 34. Tail gas 22 are fed to a hydrogen removal unit 23 wherein hydrogen 25 is separated and recycled back to the FT reactor 17 via line 27 or back to the POX (or ATR) reactor 9 via line 29 or back to both reactors after being compressed by hydrogen compressor 26. Any excess hydrogen can be exported via line 28 or hydrogen can be imported into the system from an external source via line 28. A portion of the residual tail gas 24 after hydrogen has been removed is recycled via line 32 back to the FT reactor 17 or back to the POX (or ATR) reactor 9 after being compressed by tail gas compressor 34. Tail gas 31 not recycled can be used for fuel.

Assumptions Used in the Examples of Calculated Yields

The calculated results presented in the tables presented below are based on the usual assumptions that for the POX and ATR reactions, both the water gas shift reaction and the steam methane reaction are in equilibrium at the specified temperatures. The minimum and maximum $H_2$:CO ratios for a FT reactor using a catalyst possessing no water-gas-shift activity were fixed at about 2.0. No maximum was set, but the highest value found in the calculations for maximum yields was 2.23. The minimum and maximum $H_2$:CO ratios allowed for the FT reactor using a catalyst possessing high WGS activity were about 0.7 and 2.0 respectively. The overall carbon monoxide conversion for the FT reactor containing catalyst without any WGS activity was 84% which corresponds to two reactors in series with each converting 60% of the carbon monoxide. The relatively low value of 60% carbon monoxide conversion was selected for the catalyst having no water gas shift activity since the large amount of water produced in the Fischer-Tropsch reaction inhibits the reaction. The carbon monoxide conversion for the high WGS activity case was set at 90% since much of the water produced in the Fischer-Tropsch reaction is reacted away in the water gas shift reaction, thereby reducing the inhibiting effect of water on the FT reaction. The high WGS activity was defined by setting the quotient of the product $(H_2)\times(CO_2)$ and the product $(H_2O)\times(CO)$ equal to 10 where the quantities in parentheses are moles of species leaving the FT reactor. Although at equilibrium at 250° F., the water gas shift constant is about 84, equilibrium is rarely achieved using a precipitated iron-based FT catalyst and the value according to our experience is generally about 10. The FT product distribution was modeled based upon the Schultz-Flor. carbon number distribution which states that the number of moles of species having n carbon atoms is a constant times the number of moles of species having n−1 carbon atoms. The constant in the Schultz-Flor. is referred to as the chain-growth probability for the reaction and is the same for all carbon numbers from 1 to infinity (in theory). In FT chemistry, a single constant rarely fits the data for carbon numbers from 1 to infinity. The chain-growth probability is larger at high carbon numbers than it is at low carbon numbers. In the examples calculated below, we use two chain-growth parameters- one value for carbon numbers from 1 to a transition carbon number which depends upon whether the catalyst has low or high water gas shift activity and a second chain-growth parameter for carbon numbers between the transition carbon number and infinity.

Figure 2:
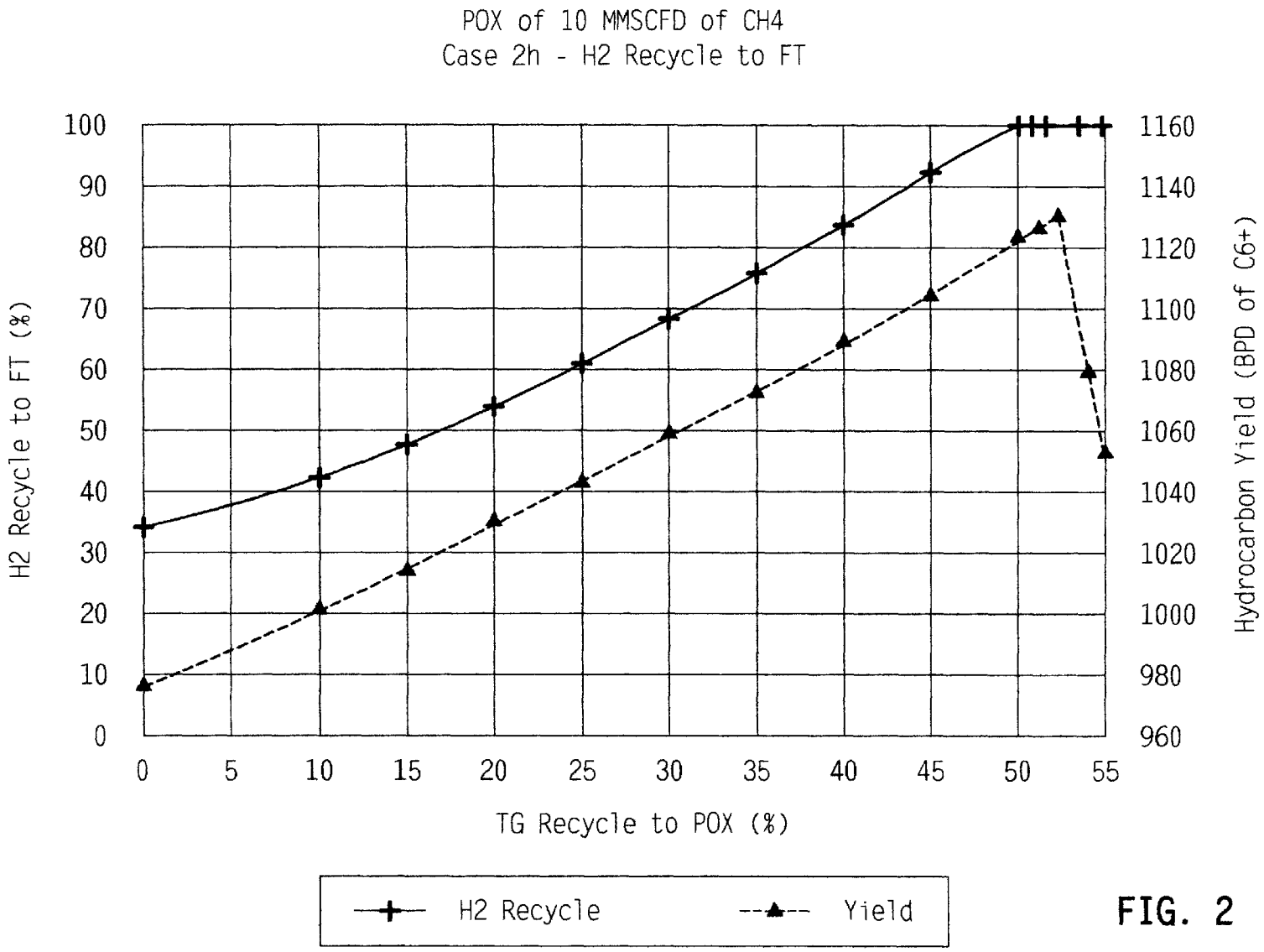
FIG. 2 is a graph showing optimization of a POX unit based on data in Case 2h.

The recycle rates shown in the tables below are the rates which give the maximum calculated yields of $C_6$+ hydrocarbons under the operating conditions specified in each table. Two examples were selected to illustrate the optimization procedure. In FIG. 2 are plots showing how the recycle rates for hydrogen and tail gas affect hydrocarbon yield for a system using oxygen for the oxidizing gas in a POX reactor and using a FT catalyst with no water gas shift activity such as cobalt (Case 2h). Each data point on FIG. 2 represents a maximum yield for a combination of tail gas and $H_2$ recycle, i.e. for a given tail gas recycle rate the hydrogen recycle rate plotted is the one that gives the maximum yield. The curve depicting hydrocarbon yield versus tail gas recycle rate peaks at 1130 BPD at a tail gas recycle rate back to the POX of about 52% and a hydrogen recycle rate back to the FT reactor of 100%. Increased tail gas recycle beyond 52% causes the $H_2$:CO ratio of the gases leaving the POX reactor to decrease and also causes the yield to decrease since steam must be added to the POX reactor in order to maintain the $H_2$:CO ratio of the gases entering the FT reactor at 2:1. The addition of steam to the POX reactor requires that more hydrocarbons fed to the POX reactor be oxidized completely to carbon dioxide and water to supply the energy necessary to heat the equilibrium mixture to the specified reaction temperature of 2100° F.

Figure 3:
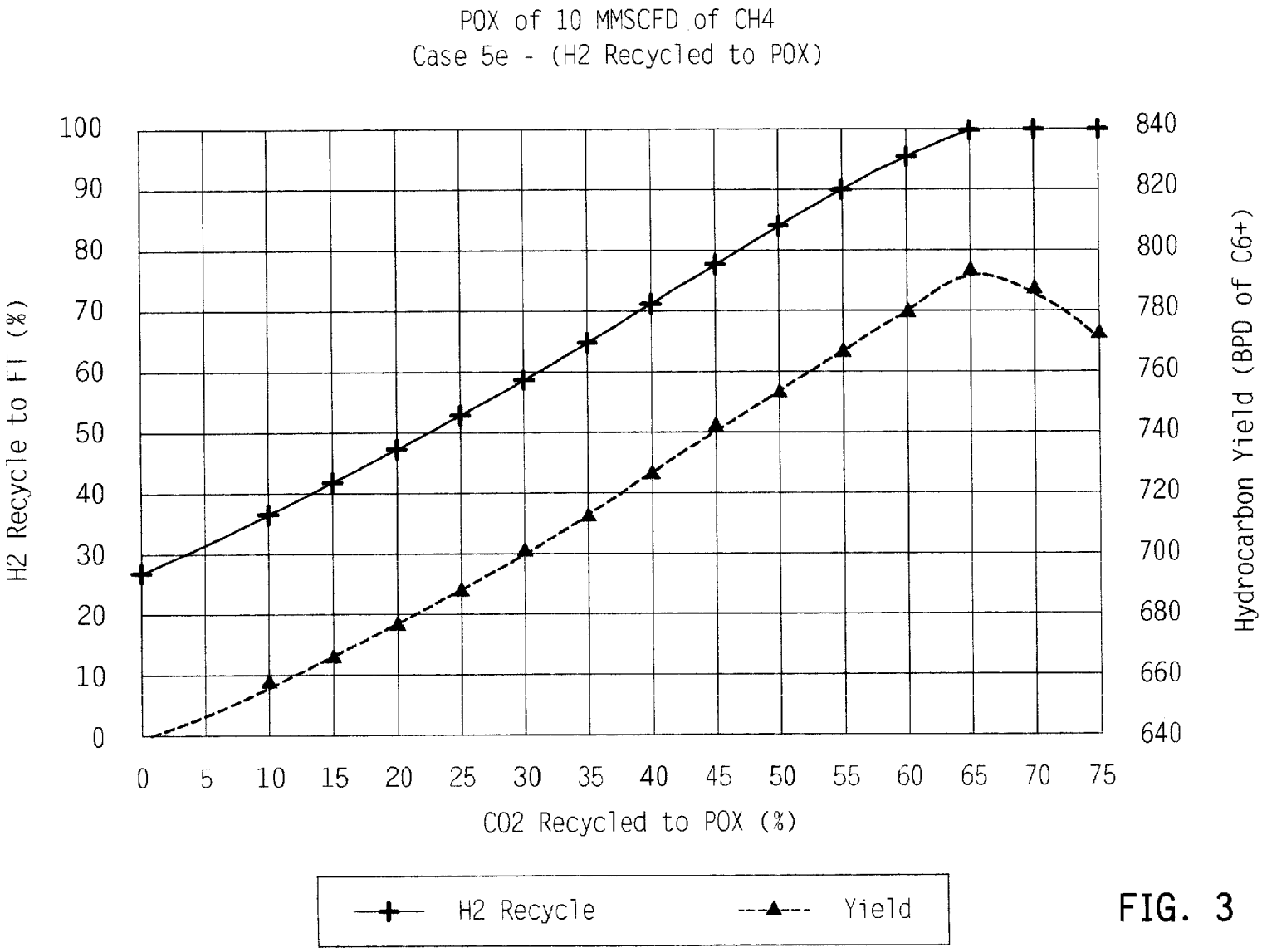
FIG. 3 is a graph showing optimization of a POX unit based on data in Case 5e.

Similar plots are shown in FIG. 3 for a system using air as the oxidizing gas in a POX reactor and a FT catalyst having high water gas shift activity (Case 5e). In this case tail gas cannot be recycled due to the high $N_2$ content of the tail gas. Instead, $CO_2$ is recycled back to the POX reactor. In this case a maximum yield is obtained at a $CO_2$ recycle rate of 65% and a $H_2$ recycle rate of 100%.

Having described the basic aspects of the invention, the following examples are given to illustrate specific embodiments thereof.

EXAMPLE 1

This example illustrates the effectiveness of $H_2$ recycle for a POX reactor using oxygen as oxidizing gas and a FT catalyst with high WGS activity (Case 1).

Equilibrium calculations were performed on a POX reactor processing 10 MMSCFD of methane and operating with an outlet pressure of 250 psia and a temperature of 2100° F. for various combinations of hydrogen, carbon dioxide, and tail gas recycle which maximized the yield of liquid hydrocarbons defined as $C_6$+. The flow rate and composition of synthesis gas from the POX unit and recycle gas were used to calculate the quantity of $C_6$+ hydrocarbons produced in a FT reactor. The results of the calculations are shown in Table 1 for a FT reactor using a catalyst having high water gas shift activity (such as iron).

TABLE 1

Effect of Recycle on Performance of a System Having a POX Reactor Using Oxygen and a FT Reactor Using a Catalyst Having High Water Gas Shift Activity for 10 MMSCFD of $CH_4$ Feedstock Part A

| | |
|---|---|
| POX Operating Conditions | |
| Pressure | 250 psia |
| Temperature | 2100° F. |
| Gas & $O_2$ Preheat | 800° F. |
| FT Operating Conditions | |
| Pressure | 225 psia |
| Temperature | 480° F. |
| CO Conversion | 90% |
| 1st Chain-growth Parameter | 0.69 |
| 2nd Chain-growth Parameter | 0.95 |
| Transition Carbon Number | 9 |

Part B

| | GASES RECYCLED (%) | | | | $O_2$ Req'd | | |
|---|---|---|---|---|---|---|---|
| Case | $CO_2$ to POX | TG to POX | $H_2$ to POX | $H_2$ to FT | (MSCF/Bd1) | $H_2$:CO | Yield BPD $C_6^+$ |
| 1a | 0 | 0 | 0 | 0 | 9.15 | 1.91 | 643 |
| 1b | 87.5 | 0 | 0 | 0 | 9.80 | 0.70 | 788 |
| 1c | 0 | 80.0 | 0 | 0 | 8.33 | 0.91 | 968 |
| 1d | 0 | 0 | 10.0 | 0 | 9.10 | 2.00 | 651 |
| 1e | 0 | 0 | 0 | 10.0 | 9.02 | 2.01 | 652 |
| 1f | 86.0 | 0 | 100 | 0 | 8.06 | 2.0 | 889 |
| 1g | 88.0 | 0 | 0 | 93.5 | 7.49 | 1.99 | 897 |
| 1h | 0 | 76.0 | 100 | 0 | 7.67 | 1.53 | 1014 |
| 1i | 0 | 78.4 | 0 | 100 | 6.89 | 2.00 | 1064 |
| 1j* | 0 | 73.2 | 0 | 100 | 7.41 | 1.95 | 1024 |
| 1k* | 0 | 76.0 | 100 | 0 | 7.67 | 1.53 | 1014 |

*Cases 1j and 1k recycle tail gas before removing hydrogen.

In these tables the $H_2$ to POX/ATR or $H_2$ to FT is the amount of the separated $H_2$ (i.e. that which has been removed from either all of the tail gas or from the remaining portion of the tail gas that has not been directly recycled back to the POX or ATR unit) which can be then directed to either the POX/ATR unit or the FT unit or both.

In this case, combined hydrogen recycle to the FT reactor and tail gas recycle (case 1i) gives nearly a 10% increase in yield and over 17% reduction in oxygen consumption over tail gas recycle only (case 1c). If the tail gas is recycled before hydrogen is removed (case 1j), the improvement in yield over tail gas recycle (case 1c) drops to 5.8% and the reduction in oxygen consumption becomes 11%. However, the flow of tail gas to the hydrogen scrubber is reduced from 22.5 MMSCFD for the case 1i to 5.8 MMSCFD for case 1j.

EXAMPLE 2

This example illustrates the effectiveness of $H_2$ recycle for a POX reactor using oxygen as oxidizing gas and a FT catalyst with no WGS activity (Case 2).

Equilibrium calculations were performed and the results are set forth in Table 2.

TABLE 2

Effect of Recycle on Performance of a System Having a POX Reactor Using Oxygen and a FT Reactor Using a Catalyst Without Water Gas Shift Activity for 10 MMSCFD of $CH_4$ Feedstock Part A

| | |
|---|---|
| POX Operating Conditions | |
| Pressure | 250 psia |
| Temperature | 2100° F. |
| Gas & $O_2$ Preheat | 800° F. |
| FT Operating Conditions | |
| Pressure | 225 psia |
| Temperature | 425° F. |
| CO Conversion | 84% |
| 1st Chain-growth Parameter | 0.66 |
| 2nd Chain-growth Parameter | 0.90 |
| Transition Carbon Number | 2 |

Part B

| | GASES RECYCLED (%) | | | | $O_2$ Req'd | Steam Req'd | | |
|---|---|---|---|---|---|---|---|---|
| Case | $CO_2$ to POX | TG to POX | $H_2$ to POX | $H_2$ to FT | (MSCF/Bd1) | (MSCF/Bd1) | $H_2$:CO | Yield BPD $C_6^+$ |
| 2a | 0 | 0 | 0 | 0 | 6.18 | 2.52 | 2.01 | 938 |
| 2b | 0 | 25.0 | 0 | 0 | 6.97 | 5.33 | 2.01 | 960 |
| 2c | 0 | 0 | 39.0 | 0 | 6.07 | 0 | 2.01 | 977 |
| 2d | 0 | 0 | 0 | 34.0 | 6.02 | 0 | 2.01 | 978 |
| 2e | 100 | 0 | 80.0 | 0 | 5.98 | 0 | 2.01 | 1017 |
| 2f | 100 | 0 | 0 | 72.0 | 5.87 | 0 | 2.01 | 1017 |
| 2g | 0 | 40.0 | 100 | 0 | 5.71 | 0 | 2.01 | 1091 |
| 2h | 0 | 51.0 | 0 | 98.1 | 5.46 | 0 | 2.03 | 1128 |
| 2i* | 0 | 46.9 | 0 | 100 | 5.58 | 0 | 2.03 | 1114 |
| 2j* | 0 | 40.0 | 100 | 0 | 5.71 | 0 | 2.01 | 1091 |

*Cases 2i and 2j recycle tail gas before removing hydrogen.

In this case, a substantial increase in yield is achieved by recycling $H_2$ and tail gas. Also there is a reduction in oxygen consumption when hydrogen is recycled. As in the previous case 1j in Table 1, recycling tail gas prior to removing hydrogen is a viable option.

EXAMPLE 3

This example illustrates the effectiveness of $H_2$ recycle for an ATR reactor using oxygen as the oxidizing gas and a FT catalyst with high WGS activity (Case 3).

In Table 3 are listed computed values of hydrocarbon yield for systems which use oxygen in an autothermal reactor (ATR) for synthesis gas generation. The ATR can be more efficient than a POX reactor since the ATR operates at a lower temperature than the POX reactor due to the use of a catalyst in the ATR. The lower temperature in the ATR reduces the amount of feedstock which must be oxidized completely to water and carbon dioxide to provide sufficient energy to achieve the operating temperature, and of course the amount of oxygen required is reduced also.

TABLE 3

Effect of Recycle on Performance of a System Having an ATR Reactor Using Oxygen and a FT Reactor Using a Catalyst Having High Water Gas Shift Activity for 10 MMSCFD of $CH_4$ Feedstock Part A

| POX Operating Conditions | |
|---|---|
| Pressure | 250 psia |
| Temperature | 1750° F. |
| Gas & $O_2$ Preheat | 800° F. |
| **FT Operating Conditions** | |
| Pressure | 225 psia |
| Temperature | 480° F. |
| Co Conversion | 90% |
| 1st Chain-growth Parameter | 0.69 |
| 2nd Chain-growth Parameter | 0.95 |
| Transition Carbon Number | 9 |

Part B

| | GASES RECYCLED (%) | | | | $O_2$ Req'd | | |
|---|---|---|---|---|---|---|---|
| Case | $CO_2$ to ATR | TG to ATR | $H_2$ to ATR | $H_2$ to FT | (MSCF/Bd1) | $H_2$:CO | Yield BPD $C_6^+$ |
| 3a | 0 | 0 | 0 | 0 | 8.82 | 1.96 | 488 |
| 3b | 92.5 | 0 | 0 | 0 | 8.66 | 0.72 | 821 |
| 3c | 0 | 86.0 | 0 | 0 | 7.30 | 0.92 | 1032 |
| 3d | 96.0 | 0 | 100 | 0 | 7.23 | 1.58 | 868 |
| 3e | 96.5 | 0 | 0 | 95.5 | 6.84 | 1.78 | 904 |
| 3f | 0 | 84.5 | 100 | 0 | 6.86 | 1.30 | 1063 |
| 3g | 0 | 84.5 | 0 | 100 | 6.16 | 1.99 | 1110 |
| 3h* | 0 | 84.5 | 0 | 100 | 6.79 | 1.36 | 1068 |
| 3j* | 0 | 84.5 | 100 | 0 | 6.86 | 1.30 | 1063 |

*Cases 3h and 3i recycle tail gas before removing hydrogen.

By combining $H_2$ recycle to the FT reactor with tail gas recycle, the hydrocarbon yield is increased by about 7.5% and the oxygen consumption is reduced by about 15.5% when compared to tail gas recycle only. Recycling tail gas before removing hydrogen may be the preferred option due to the smaller $H_2$ scrubber required.

EXAMPLE 4

This example illustrates the effectiveness of $H_2$ recycle for an ATR reactor using oxygen as the oxidizing gas and a FT catalyst with no WGS activity (Case 4).

Equilibrium calculations were performed and the results are set forth in Table 4.

TABLE 4

Effect of Recycle on Performance of a System Comprised of an ATR Reactor Using Oxygen and a FT Reactor Using a Catalyst Without Water Gas Shift Activity for 10 MMSCFD of $CH_4$ Feedstock Part A

| POX Operating Conditions | |
|---|---|
| Pressure | 250 psia |
| Temperature | 1750° F. |
| Gas & $O_2$ Preheat | 800° F. |

TABLE 4-continued

Effect of Recycle on Performance of a System Comprised of an ATR Reactor Using Oxygen and a FT Reactor Using a Catalyst Without Water Gas Shift Activity for 10 MMSCFD of $CH_4$ Feedstock

| FT Operating Conditions | |
|---|---|
| Pressure | 225 psia |
| Temperature | 425° F. |
| CO Conversion | 84% |
| 1st Chain-growth Parameter | 0.66 |
| 2nd Chain-growth Parameter | 0.90 |
| Transition Carbon Number | 2 |

Part B

| | GASES RECYCLED (%) | | | | $O_2$ | Steam | | |
|---|---|---|---|---|---|---|---|---|
| Case | $CO_2$ to ATR | TG to ATR | $H_2$ to ATR | $H_2$ to FT | Req'd (MSCF/Bd1) | Req'd (MSCF/Bd1) | $H_2$:CO | Yield BPD $C_6^+$ |
| 4a | 0 | 0 | 0 | 0 | 5.92 | 0.68 | 2.01 | 778 |
| 4b | 66 | 0 | 0 | 0 | 6.62 | 6.49 | 2.01 | 908 |
| 4c | 0 | 61.3 | 0 | 0 | 6.23 | 6.88 | 2.01 | 1044 |
| 4d | 0 | 0 | 17.5 | 0 | 5.88 | 0 | 2.01 | 734 |
| 4e | 0 | 0 | 0 | 16.5 | 5.85 | 0 | 2.01 | 737 |
| 4f | 74.0 | 0 | 24.0 | 0 | 6.47 | 5.88 | 2.01 | 927 |
| 4g | 74.5 | 0 | 0 | 22.5 | 6.53 | 6.27 | 2.01 | 928 |
| 4h | 0 | 68.5 | 100 | 0 | 5.80 | 4.81 | 2.01 | 1105 |
| 4i | 0 | 70.0 | 0 | 100 | 5.31 | 2.30 | 2.01 | 1130 |
| 4j* | 0 | 69.0 | 0 | 100 | 5.60 | 4.33 | 2.01 | 1111 |
| 4k* | 0 | 68.5 | 100 | 0 | 5.8 | 4.81 | 2.01 | 1105 |

*Cases 4j and 4k recycle tail gas before removing hydrogen.

In this case, yield is improved by about 8% and oxygen consumption is reduced by about 15% using $H_2$ recycle and tail gas recycle compared to tail gas recycle only. Again, recycling tail gas prior to removing hydrogen is a viable option.

The following section describes a system using air as the oxidizing gas in the synthesis gas production apparatus.

Figure 4:
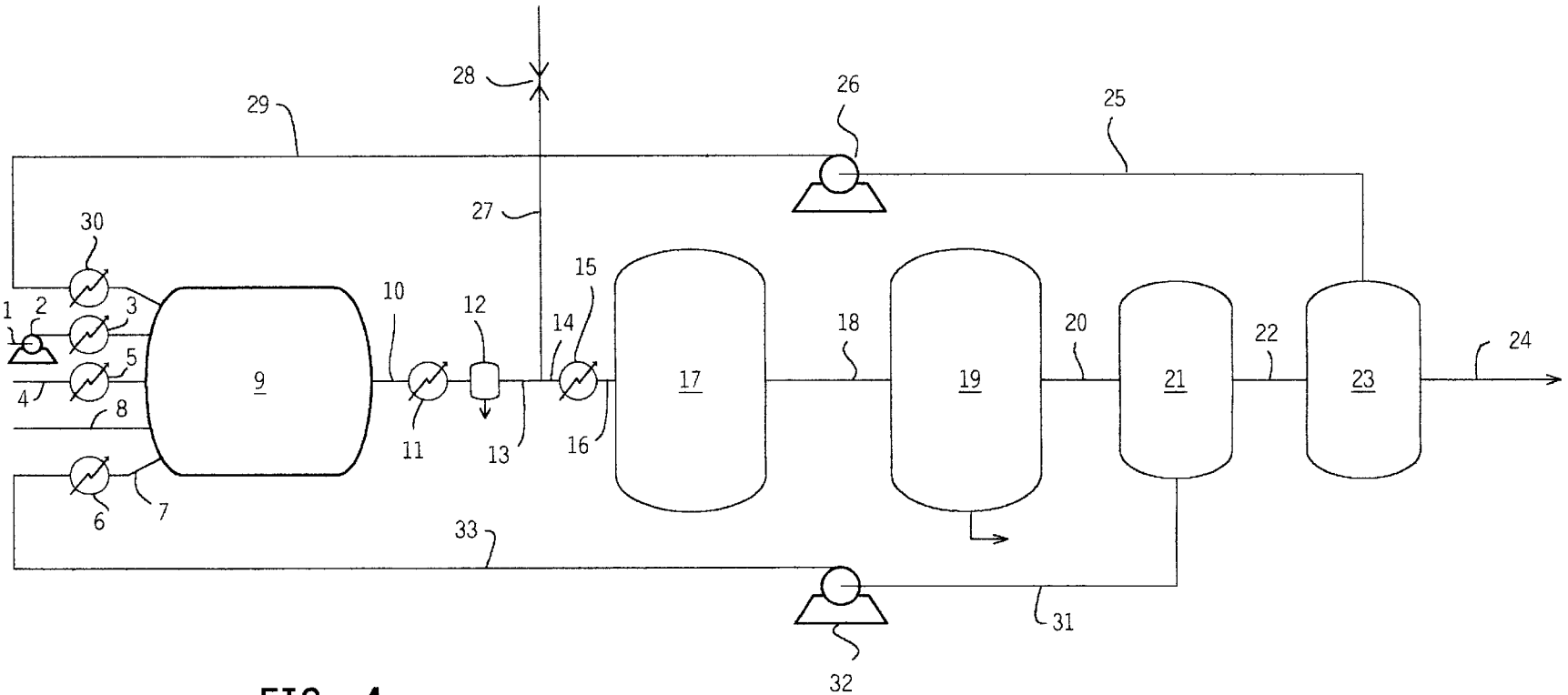
FIG. 4 is a diagram of a system using air as the oxidizing gas in the POX (or ATR) reactor.

A diagram of a system using air as the oxidizing gas in the POX (or ATR) reactor is shown in FIG. 4. Referring to FIG. 4, a stream of air 2 from air compressor 1 is fed to POX (or ATR) reactor 9 after being heated in preheater 3. Natural gas 4 is preheated in preheater 5 and fed to POX (or ATR) reactor 9 along with carbon dioxide 7 which has been compressed in compressor 32 and preheated in preheater 6. Optionally, the recycled carbon dioxide 31 and air 0 can be co-compressed in compressor 1 before being preheated in preheater 3. Preheated steam 8, if required, is fed to the POX (or ATR) reactor. The hydrogen removed in separator 23 which is to be recycled in line 25 is compressed in hydrogen compressor 26 and is recycled to the FT reactor 17 in line 27 or recycled to the POX (or ATR) reactor 9 in line 29 and preheated in preheater 30. The recycled hydrogen 25 can be divided between recycle to the FT reactor 17 via line 27 and recycle to the POX (ATR) via line 29. Excess hydrogen can be exported for other uses or hydrogen can be imported to the system via line 28. The gases 10 exiting the POX (ATR) reactor 9 are a mixture of hydrogen and carbon monoxide (synthesis gas) and nitrogen, steam, methane, and carbon dioxide. The gases exiting the reactor are cooled by heat exchanger 11 and water is removed in separator vessel 12. The dry synthesis gas 13 and recycled hydrogen 27 are heated in heat exchanger 15 and fed to the FT reactor 17. The gases 18 leaving the FT reactor 17 contain hydrocarbon product and other condensibles which are removed in product separation unit 19. The gases 20 leaving the product separation section 19 are fed to a carbon dioxide removal system 21 where carbon dioxide 31 is separated from the other gases 22. The remaining gases 22 are fed to a hydrogen removal unit 23 where hydrogen to be recycled 25 is separated from the remaining tail gas 24.

EXAMPLE 5

This example illustrates the effectiveness of $H_2$ recycle for a POX reactor using air as the oxidizing gas and a FT catalyst with high WGS activity (Case 5).

In Table 5 are the results of calculations for systems which use air instead of oxygen for the POX reactor as described above. The use of air precludes recycling tail gas due to the large amount of nitrogen, but $H_2$ and $CO_2$ can be separated from the tail gas and recycled.

TABLE 5

Effect of Recycle on Performance of a System Having a POX Reactor Using Air and a FT Reactor Using a Catalyst Having High Water Gas Shift Activity for 10 MMSCFD of $CH_4$ Feedstock Part A

| | |
|---|---|
| POX Operating Conditions | |
| Pressure | 250 psia |
| Temperature | 2100° F. |
| Gas & $O_2$ Preheat | 800° F. |
| FT Operating Conditions | |
| Pressure | 225 psia |
| Temperature | 480° F. |
| CO Conversion | 90% |
| 1st Chain-growth Parameter | 0.69 |
| 2nd Chain-growth Parameter | 0.95 |
| Transition Carbon Number | 9 |

Part B

| | GASES RECYCLED (%) | | | | | | |
|---|---|---|---|---|---|---|---|
| Case | $CO_2$ to POX | TG to POX | $H_2$ to POX | $H_2$ to FT | Air Req'd (MSCF/Bdl) | $H_2$:CO | Yield BPD $C_6$+ |
| 5a | 0 | 0 | 0 | 0 | 56.8 | 1.78 | 616 |
| 5b | 70.0 | 0 | 0 | 0 | 59.3 | 0.92 | 694 |
| 5c | 0 | 0 | 27.0 | | 55.8 | 2.00 | 639 |
| 5d | 0 | 0 | 0 | 23.0 | 54.8 | 2.01 | 638 |
| 5e | 62.5 | 0 | 100 | 0 | 51.0 | 2.00 | 796 |
| 5f | 73.0 | 0 | 0 | 100 | 47.5 | 2.00 | 822 |

In this case, $H_2$ recycle to the FT combined with $CO_2$ recycle gives an 18.4% increase in yield over using $CO_2$ recycle alone. The air consumption is decreased by nearly 20%. Air consumption is important because the air must be compressed to the POX operating pressure. Also equipment size increases as the amount of air increases.

EXAMPLE 6

This example illustrates the effectiveness of $H_2$ recycle for a POX reactor using air as oxidizing gas and a FT catalyst with no WGS activity (Case 6).

Equilibrium calculations were performed and the results are set forth in Table 6.

TABLE 6

Effect of Recycle on Performance of a System Comprised of a POX Reactor Using Air and a FT Reactor Using a Catalyst Without Water Gas Shift Activity for 10 MMSCFD of $CH_4$ Feedstock Part A

| | |
|---|---|
| POX Operating Conditions | |
| Pressure | 250 psia |
| Temperature | 2100° F. |
| Gas & $O_2$ Preheat | 800° F. |
| FT Operating Conditions | |
| Pressure | 225 psia |
| Temperature | 425° F. |
| CO Conversion | 84% |
| 1st Chain-growth Parameter | 0.66 |
| 2nd Chain-growth Parameter | 0.90 |
| Transition Carbon Number | 2 |

Part B

| | GASES RECYCLED (%) | | | | Air | Steam | | |
|---|---|---|---|---|---|---|---|---|
| Case | $CO_2$ to POX | TG to POX | $H_2$ to POX | $H_2$ to FT | Req'd (MSCF/Bd1) | Req'd (MSCF/Bd1) | $H_2$:CO | Yield BPD $C_6^+$ |
| 6a | 0 | 0 | 0 | 0 | 48.1 | 7.33 | 2.01 | 808 |
| 6b | 10.0 | 0 | 0 | 0 | 51.0 | 9.73 | 2.01 | 789 |
| 6c | 0 | 0 | 94.5 | 0 | 32.8 | 0 | 2.04 | 957 |
| 6d | 0 | 0 | 0 | 86.0 | 37.6 | 0 | 2.23 | 933 |
| 6e | 11.1 | 0 | 100 | 0 | 38.0 | 0.08 | 2.01 | 943 |
| 6f | 90.0 | 0 | 0 | 100 | 35.8 | 0 | 2.22 | 1012 |

For this case wherein the FT catalyst has no WGS activity, 100% $H_2$ recycle to the FT reactor with 90% $CO_2$ recycle (case 6f) would provide a 5.7% increase in yield and about 6% decrease in air consumption per barrel of product over the case wherein hydrogen only is recycled to the POX reactor (case 6c). In this case, it may be preferable to recycle only hydrogen and eliminate the $CO_2$ absorber and stripper.

EXAMPLE 7

This example illustrates the effectiveness of $H_2$ recycle for an ATR reactor using air as oxidizing gas and a FT catalyst with high WGS activity (Case 7).

Equilibrium calculations were performed and the results are set forth in Table 7.

TABLE 7

Effect of Recycle on Performance of a System Comprised of an ATR Reactor Using Air and a FT Reactor Using a Catalyst Having High Water Gas Shift Activity for 10 MMSCFD of $CH_4$ Feedstock Part A

| | |
|---|---|
| POX Operating Conditions | |
| Pressure | 250 psia |
| Temperature | 1750° F. |
| Gas & $O_2$ Preheat | 800° F. |
| FT Operating Conditions | |
| Pressure | 225 psia |
| Temperature | 480° F. |
| CO Conversion | 90% |
| 1st Chain-growth Parameter | 0.69 |
| 2nd Chain-growth Parameter | 0.95 |
| Transition Carbon Number | 9 |

TABLE 7-continued

Effect of Recycle on Performance of a System Comprised of an ATR Reactor Using Air and a FT Reactor Using a Catalyst Having High Water Gas Shift Activity for 10 MMSCFD of $CH_4$ Feedstock Part B

| | GASES RECYCLED (%) | | | | Air Req'd | | |
|---|---|---|---|---|---|---|---|
| Case | $CO_2$ to ATR | TG to ATR | $H_2$ to ATR | $H_2$ to FT | (MSCF/Bd1) | $H_2$:CO | Yield BPD $C_6^+$ |
| 7a | 0 | 0 | 0 | 0 | 47.9 | 1.92 | 604 |
| 7b | 85.0 | 0 | 0 | 0 | 49.0 | 0.82 | 763 |
| 7c | 85.5 | 0 | 100 | 0 | 41.1 | 1.70 | 850 |
| 7d | 90.0 | 0 | 0 | 100 | 41.9 | 1.41 | 858 |

A significant increase in yield is realized when $H_2$ recycle is coupled with $CO_2$ recycle.

EXAMPLE 8

This example illustrates the effectiveness of $H_2$ recycle for an ATR reactor using air as the oxidizing gas and a FT catalyst with no WGS activity (Case 8).

Equilibrium calculations were performed and the results are set forth in Table 8.

TABLE 8

Effect of Recycle on Performance of a System Comprised of an ATR Reactor Using Air and a FT Reactor Using a Catalyst Without Water Gas Shift Activity for 10 MMSCFD of $CH_4$ Feedstock Part A

| POX Operating Conditions | |
|---|---|
| Pressure | 250 psia |
| Temperature | 1750° F. |
| Gas & $O_2$ Preheat | 800° F. |
| **FT Operating Conditions** | |
| Pressure | 225 psia |
| Temperature | 425° F. |
| CO Conversion | 84% |
| 1st Chain-growth Parameter | 0.66 |
| 2nd Chain-growth Parameter | 0.90 |
| Transition Carbon Number | 2 |

Part B

| | GASES RECYCLED (%) | | | | $O_2$ | Steam | | |
|---|---|---|---|---|---|---|---|---|
| Case | $CO_2$ to ATR | TG to ATR | $H_2$ to ATR | $H_2$ to FT | Req'd (MSCF/Bd1) | Req'd (MSCF/Bd1) | $H_2$:CO | Yield BPD $C_6^+$ |
| 8a | 0 | 0 | 0 | 0 | 33.7 | 1.33 | 2.01 | 889 |
| 8b | 11.0 | 0 | 0 | 0 | 34.1 | 1.83 | 2.01 | 891 |
| 8c | 0 | 0 | 30.0 | 0 | 32.3 | 0 | 2.01 | 899 |
| 8d | 0 | 0 | 0 | 30.0 | 32.1 | 0 | 2.02 | 901 |
| 8e | 87.6 | 0 | 100 | 0 | 31.3 | 0 | 2.03 | 968 |
| 8f | 97.0 | 0 | 0 | 97.0 | 30.6 | 0 | 2.01 | 990 |

As in the previous case, a significant increase in yield results from combining $H_2$ recycle with $CO_2$ recycle.

The foregoing detailed description is given merely by way of illustration. Many variations may be made without departing from the spirit of this invention.

What is claimed is:

1. A method of producing liquid hydrocarbons from natural gas, said method comprising steps of producing a synthesis gas by oxidizing a natural gas feedstock with oxygen in a synthesis gas production reactor, converting the synthesis gas to a liquid hydrocarbon and tail gas containing hydrogen by passing the synthesis gas through a Fischer-Tropsch reactor containing a catalyst exhibiting high water gas shift activity, separating at least a portion of the hydrogen from the tail gas so as to produce a hydrogen-depleted tail gas fraction, and recycling at least a portion of said separated hydrogen to the Fischer-Tropsch reactor and at least a portion of said hydrogen-depleted tail gas fraction to the synthesis gas production reactor.

2. A method according to claim 1, wherein said catalyst is an iron catalyst.

3. A method according to claim 1, wherein the synthesis gas production reactor is a partial oxidation reactor.

4. A method according to claim 1, wherein the catalyst is a cobalt catalyst.

5. A method according to claim 3, wherein approximately 85% to 100% of the hydrogen is recycled to the Fischer-Tropsch reactor and approximately 70% to 80% of the hydrogen-depleted tail gas is recycled to the synthesis gas production reactor.

6. A method according to claim 1, wherein the synthesis reactor is an autothermal reactor.

7. A method according to claim 6, wherein approximately 85% to 100% of the hydrogen is recycled to the Fischer-Tropsch reactor and approximately 60% to 80% of the hydrogen-depleted tail gas is recycled to the synthesis gas production reactor.

* * * * *